US006206135B1

(12) United States Patent
Kim et al.

(10) Patent No.: US 6,206,135 B1
(45) Date of Patent: Mar. 27, 2001

(54) SUCTION NOISE MUFFLER FOR HERMETIC COMPRESSOR

(75) Inventors: Tae Min Kim; Sang Min Lee, both of Kyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/092,435

(22) Filed: Jun. 5, 1998

Related U.S. Application Data

(62) Division of application No. 08/739,171, filed on Oct. 30, 1996, now Pat. No. 5,804,777.

(30) Foreign Application Priority Data

Nov. 2, 1995 (KR) ..... 95-39367
Dec. 26, 1995 (KR) ..... 95-56432

(51) Int. Cl.[7] ..... F02M 25/00
(52) U.S. Cl. ..... 181/229
(58) Field of Search ..... 181/229, 264, 181/265, 268, 272, 275, 282, 403; 417/312, 902

(56) References Cited

U.S. PATENT DOCUMENTS

| | | | | |
|---|---|---|---|---|
| 5,201,640 | | 4/1993 | Heinzelmann et al. | 417/312 |
| 5,304,044 | | 4/1994 | Wada et al. | 417/312 |
| 5,451,728 | * | 9/1995 | Chandler et al. | 181/230 |
| 5,669,762 | * | 9/1997 | Lee | 417/312 |

* cited by examiner

*Primary Examiner*—Khanh Dang
(74) *Attorney, Agent, or Firm*—Ostrolenk, Faber, Gerb & Soffen, LL

(57) ABSTRACT

A suction noise muffler for a hermetic compressor which is capable of enabling a smooth flow of a refrigerant gas and reducing a suction noise by forming a predetermined shaped refrigerant gas flow guide path and a plurality of noise reducing sections, which includes an upper casing having a rectangular outer wall and a plurality of inner walls arranged within the outer wall, and a lower casing whereby the upper casing is inserted into the lower casing, for thus forming a refrigerant gas flowing path and a plurality of noise reducing sections thereby when assembling the upper casing and lower casing.

10 Claims, 15 Drawing Sheets

SUCTION NOISE MUFFLER FOR HERMETIC COMPRESSOR

This is a division of application Ser. No. 08/739,171, filed Oct. 30, 1996 now U.S. Pat. No. 5,804,777.

BACKGROUND OF THE INVENTION

1. Field of the Invention

The present invention relates to a suction noise muffler for a hermetic compressor, and particularly to an improved suction noise muffler for a hermetic compressor which is capable of enabling a smooth flow of a refrigerant gas and reducing a suction noise by forming a predetermined shaped guide path for a refrigerant gas flow and a plurality of noise reducing sections.

2. Description of the Conventional Art

Referring to FIGS. 1 through 3, a conventional hermetic compressor will now be explained. A housing 1 includes a motor unit 4 having a stator 2 and a rotor 3, with the stator 2 and the rotor 3 being arranged in a lower portion inside the housing 1. A crank shaft 5 is inserted into the center portion of the rotor 3 of the motor unit 4.

An eccentric portion 6 is formed in an upper portion of the crank shaft S. A piston 8 is inserted within a cylinder 7 arranged in an upper portion inside the housing 1, with the piston 8 reciprocating within the cylinder 7 in cooperation with the rotation of the eccentric portion 6 of the crank shaft 5.

A valve plate 9 is arranged in a portion of the cylinder 7 for controlling the flow of the refrigerant gas. A suction noise muffler 10 and a discharge noise muffler (not shown) are arranged in the valve plate 9.

A cylinder head cover 11 is disposed in an upper portion of the suction noise muffler 10 and the discharge noise muffler (not shown).

An elongated wall 14 is arranged inside the suction noise muffler 10. A first noise reducing section 12 and a second noise reducing section 13 are defined by the elongated wall 14. An inlet 15 is formed in a portion of the suction noise muffler 10, through which inlet 15 the refrigerant gas is introduced.

An insertion hole 16 is formed in a predetermined portion of the elongated wall 14, into which hole 16 a guide tube 17 is inserted for guiding the flow of the refrigerant gas.

An outlet 19 is formed opposite the inlet 15 of the suction noise muffler 10 in order for the refrigerant gas to be guided to a suction hole 18 of the valve plate 9.

The operation of the conventional hermetic compressor will now be explained with reference to FIGS. 1 through 3.

First, when current voltage is supplied to the motor unit 4, the rotor 3 rotates, and the crank shaft 5 drivingly inserted into the rotor 3 is rotated thereby. The eccentric portion 6 of the crank shaft 5 causes the piston 8 to horizontally reciprocate within the cylinder 7.

The suction force which is generated in accordance with the horizontally reciprocating movement of the piston 8 serves to introduce the refrigerant gas into the cylinder 7 through the suction noise muffler 10.

The above-described process will now be explained in more detail.

The refrigerant gas is introduced into the system through the inlet 15 of the suction noise muffler 10. The noise contained in the introduced refrigerant gas is reduced by the first noise reducing section 12, and is guided to the second noise reducing section 13 through the guide tube 17, and the noise is further reduced by the second noise reducing section 13. Thereafter, the refrigerant gas is discharged through the outlet 19 and is introduced into the cylinder 7 through the suction hole 18 of the valve plate 9.

The refrigerant gas introduced into the cylinder 7 is compressed and discharged by the reciprocating movement of the piston 8.

However, since the suction noise muffler 10 is fabricated by a ultrasonic melting method after the guide tube 17 is inserted into the insertion hole 16, the productivity is decreased due to the complicated fabrication process.

In addition, since the refrigerant gas is not smoothly flown in the system due to a burr which is formed during the ultrasonic melting process, the performance of the suction noise muffler 10 is degraded.

FIGS. 4 and 5 illustrate another conventional hermetic compressor which was disclosed in the U.S. Pat. No. 5,304,044. As shown therein, a motor unit 21 is arranged in an upper portion inside a housing 20, with the motor unit 21 including a rotor (not shown) and a stator (not shown) for driving a crank shaft (not shown). A cylinder 22 and a piston 23 are arranged in a lower portion inside the housing 20.

On side of a valve plate 24 is attached to one side of the cylinder 22. Another side of the valve plate 24 is attached to a cylinder head cover 25 in cooperation with a predetermined engaging member (not shown).

The suction noise muffler 26 includes a cover 27, an upper casing 28, and a lower casing 29. The cover 27 is engaged to the upper portion of the upper casing 28 engaged to the upper portion of the lower casing 29.

A cylindrical first chamber 30 is vertically formed in the lower casing 29, and a connection duct 31 is formed within the lower casing 29 and beside the first chamber 30.

In the upper casing 28, a second chamber 32 is formed above the first chamber 30. A hole 33 is formed in a wall formed between the first chamber 30 and the second chamber 32 in order for the refrigerant gas to communicate between the first chamber 30 and the second chamber 32. A third chamber 34 is formed beside the second chamber 32 and within the upper casing 28, with the third chamber 34 communicating with the second chamber 32.

A first insertion hole 36 is formed in a lower portion of the connection duct 31 of the lower casing 29, with a capillary tube 35 being inserted into the first insertion hole 36. A discharge hole 37 is formed in a lower portion of the connection duct 31 in order for the refrigerant gas to be discharged through the discharge hole 37.

An insertion groove 38 is formed above the cylinder head cover 25 in order for the connection duct 31 of the suction noise muffler 26 to be tightly attached to the insertion groove 38.

A small suction room 39 is formed in a lower portion of the insertion groove 38 in order for a predetermined amount of the refrigerant gas discharged from the discharge hole 37 to be gathered therein.

A discharge room 40 having a larger space than that of the suction room 39 is formed in the lower portion of the suction room 39.

A suction port 41 is formed in the valve plate 24 at a portion lower than the suction room 39 in order for the refrigerant gas introduced into the suction room 39 to be easily introduced into the cylinder 22.

A clamp 42 shown in FIG. 4 is disposed above the cylinder head cover 25 for clamping the suction noise muffler 26 and the capillary tube 35.

The operation of another conventional hermetic compressor will now be explained with reference to FIGS. 4 and 5.

First, when the rotor (not shown) of the motor unit 21 rotates, the crank shaft (not shown) drivingly connected with the rotor is rotated, so that the piston 23 reciprocates within the cylinder 22.

The suction force generated in the cylinder 22 in cooperation with the reciprocating movement of the piston 23 causes the refrigerant gas to be introduced into the suction noise muffler 26, and the noise contained in the thusly introduced refrigerant gas is gradually reduced through the first chamber 30, the second chamber 32, the third chamber 34, and the connection duct 31.

Thereafter, the refrigerant gas is introduced into the cylinder 22 through the discharge hole 37, the suction room 39, and the suction port 41, and is compressed by the piston 23 and is moved to the discharge room 40.

However, since all of the first chamber 30, the second chamber 32, the third chamber 34, and the connection duct 31 causes a resonant effect therein, a noise reducing effect is decreased.

FIGS. 6 through 8 illustrate still another conventional hermetic compressor which was disclosed in the U.S. Pat. No. 5,201,640. As shown therein, a motor unit 46 having a stator 44 and a rotor 45 is disposed in a lower portion inside a housing 43. A crank shaft 47 is inserted into the rotor 45.

A compression unit having a cylinder 48 and a piston 49 is disposed at an upper portion inside the housing 43. The piston 49 connected to the crank shaft 47 reciprocates within the cylinder 48.

One side of a valve plate 50 is attached to one side of the cylinder 48. A cylinder head cover 51 is arranged at another side of the valve plate 50.

A discharge room 52 is formed above the cylinder head cover 51, and an engaging groove 54 is formed below the discharge room 52 for being engaged with a shell-shaped suction noise muffler 53.

The suction noise muffler 53 includes a lower casing 55 and an upper casing 56 which are coupled together by a clamp 57.

An inlet 58 is formed in a lower portion of the lower casing 55 in order for the refrigerant gas to be introduced through the inlet 58. A guide pipe 59 is disposed in the central portion of the lower casing 55 in order for the refrigerant gas to be guided thereby, with the guide pipe 59 being curved horizontally and vertically.

A wall 61 is vertically formed in the outer portion of the guide pipe 59 and defines a suction noise reducing section 60 at both sides of the wall 61.

A plurality of input/output holes 62 are formed in both sides of the guide pipe 59 in order for the refrigerant gas to be introduced and discharged therethrough.

A suction duct 64 is formed at one end of the guide pipe 59 in order for the refrigerant gas flowing along the guide pipe 59 to be guided to the inlet 63 of the valve plate 50.

An outlet 65 is formed in an upper end portion of the suction duct 64 in order for the refrigerant gas to be discharged through the outlet 65.

The operation of the conventional hermetic compressor will now be explained with reference to FIGS. 6 through 8.

First, when the motor unit 46 receives current voltage, the crank shaft 47 drivingly connected with the rotor 45 of the motor unit 46 is rotated, and the piston 49 connected with the crank shaft 47 reciprocates within the cylinder 48.

The suction force generated in the cylinder 48 in cooperation with the reciprocating movement of the piston 49 is guided to the guide pipe 59 through the inlet 58 of the suction noise muffler 53.

The refrigerant gas introduced into the guide pipe 59 is discharged to the suction noise reducing section 60 through the inlet/outlet holes 62, and the noise contained in the refrigerant gas is reduced therein. The noise-reduced refrigerant gas is introduced into the guide pipe 59 through the inlet/outlet holes 62, and the thusly introduced refrigerant gas moves along the suction duct 64 and is introduced into the inlet 63 formed in the valve plate 50.

The refrigerant gas introduced into the cylinder 48 through the inlet 63 is compressed by the, piston 49, and is moved to the discharge room 52 of the valve plate 50.

Meanwhile, a lubricating oil gathered in the bottom portion of the housing 43 is upwardly moved by a centrifugal force generated by a rotational force of the crank shaft 47, and is sprayed to the motor unit 46 and friction sections of the system, so that a cooling operation with respect to the heated portions of the system and a lubricating operation are performed. Thereafter, the thusly sprayed lubricating oil is again gathered at the bottom portion of the housing 43. The above-described operation is repeatedly performed.

However, since in order to dispose the suction noise muffler 53 in the housing 43, the upper casing 56 must be assembled to the system after the guide pipe 59 is inserted into the lower casing 55, so that the productivity is significantly decreased.

SUMMARY OF THE INVENTION

Accordingly, it is an object of the present invention to provide a suction noise muffler for a hermetic compressor which overcomes the limitations of the conventional suction noise muffler for a hermetic compressor.

It is another object of the present invention to provide a suction noise muffler for a hermetic compressor which is capable of enabling a smooth flow of a refrigerant gas and reducing a suction noise by forming a predetermined shaped refrigerant gas flow guide path and a plurality of noise reducing sections.

To achieve the above objects, in accordance with a first embodiment of the present invention, there is provided a suction noise muffler for a hermetic compressor which includes an upper casing having a rectangular outer wall and a plurality of inner walls arranged within the outer wall, and a lower casing whereby the upper casing is inserted into the lower casing, for thus forming a refrigerant gas flowing path and a plurality of noise reducing sections thereby when assembling the upper casing and lower casing.

To achieve the above objects, in accordance with a second embodiment of the present invention, there is provided a suction noise muffler for a hermetic compressor which includes an upper casing having a plurality of outer walls and inner walls, and a lower casing having a plurality of outer walls and inner walls whereby an inlet, a guide path, a fixing section, and a plurality of noise reducing sections are formed when the upper casing and lower casing are assembled.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
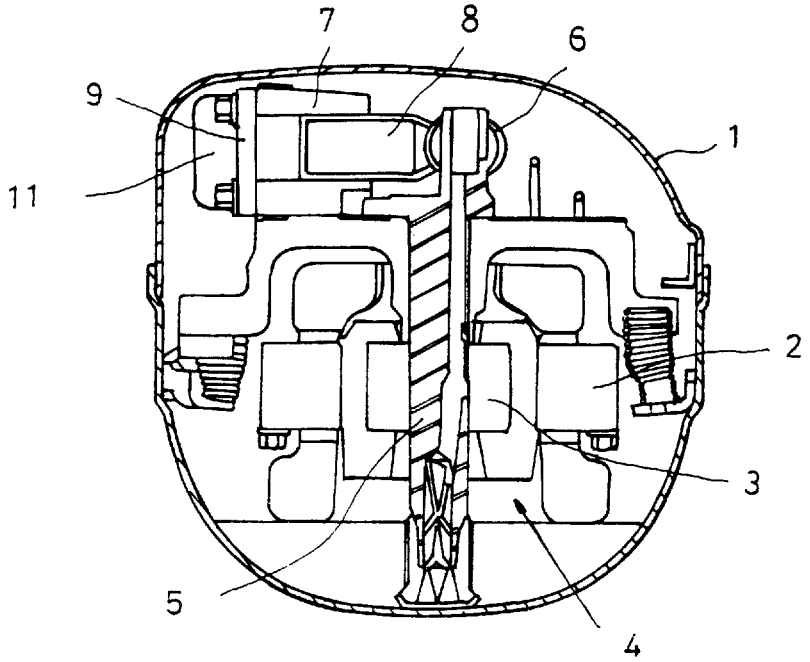
FIG. 1 CONVENTIONAL ART
FIG. 1 is a cross-sectional view illustrating the construction of a conventional hermetic compressor.
Figure 2:
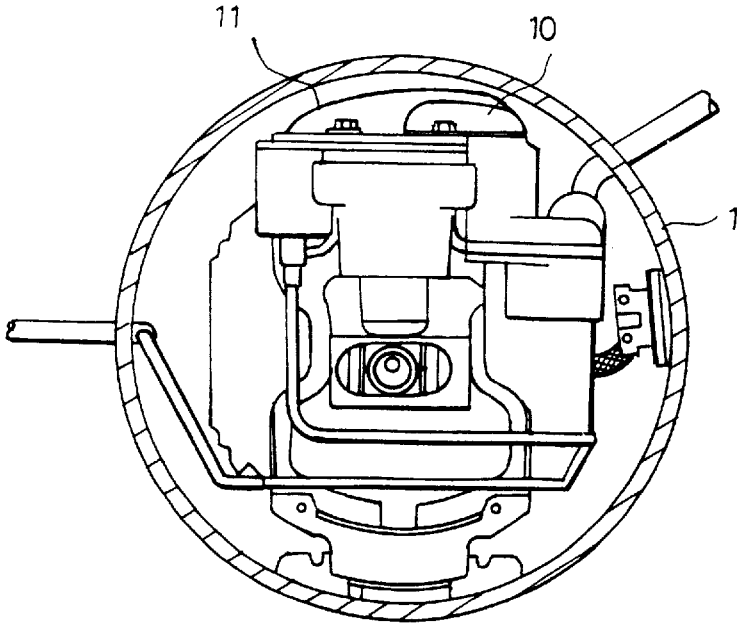
FIG. 2 CONVENTIONAL ART
FIG. 2 is a plan view of FIG. 1.
Figure 3:
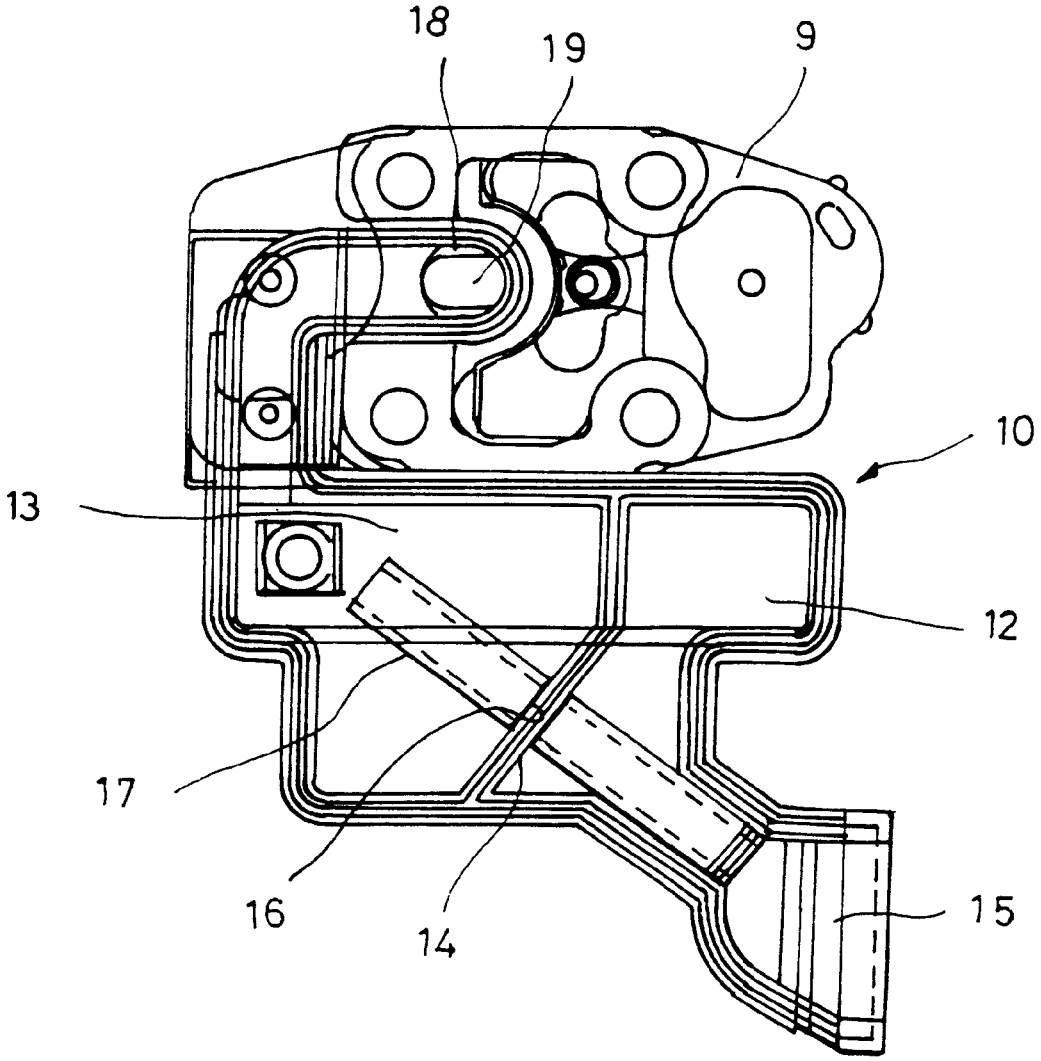
FIG. 3 CONVENTIONAL ART
FIG. 3 is a cross-sectional view illustrating a conventional suction noise muffler for a hermetic compressor.
Figure 4:
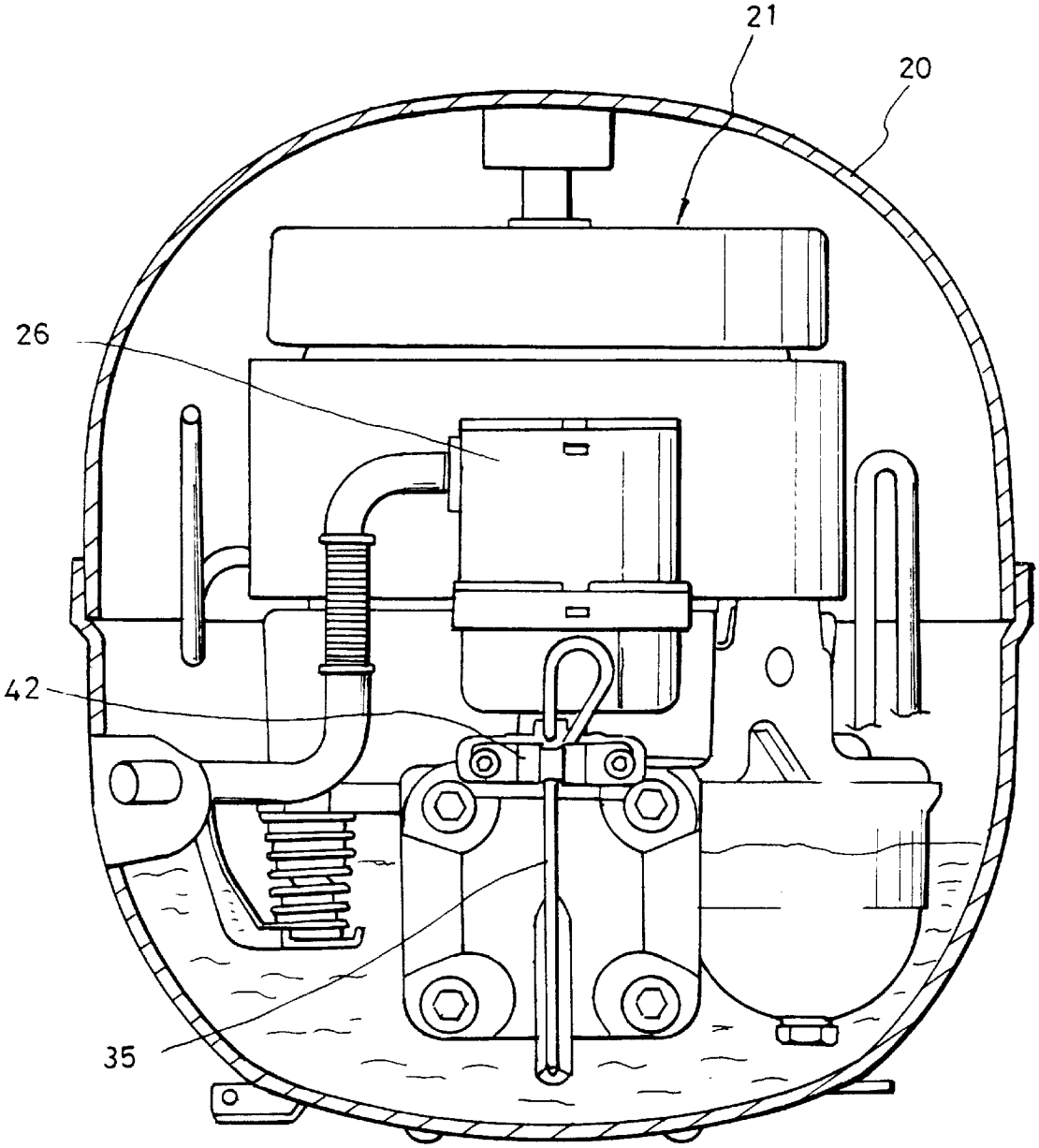
FIG. 4 CONVENTIONAL ART
FIG. 4 is a cross-sectional view illustrating the construction of another conventional hermetic compressor.
Figure 5:
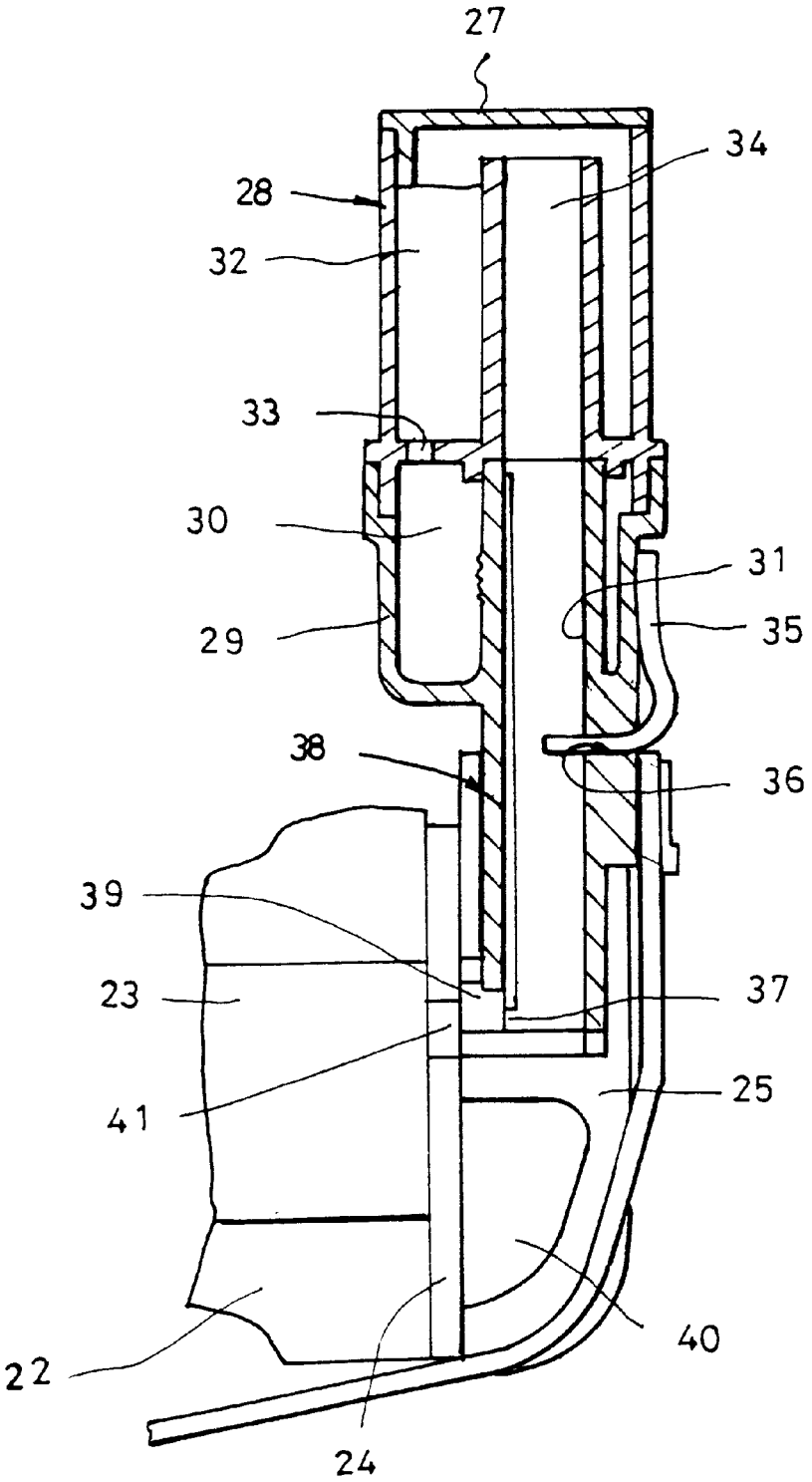
FIG. 5 CONVENTIONAL ART
FIG. 5 is a partial cross-sectional of FIG. 4.
Figure 6:
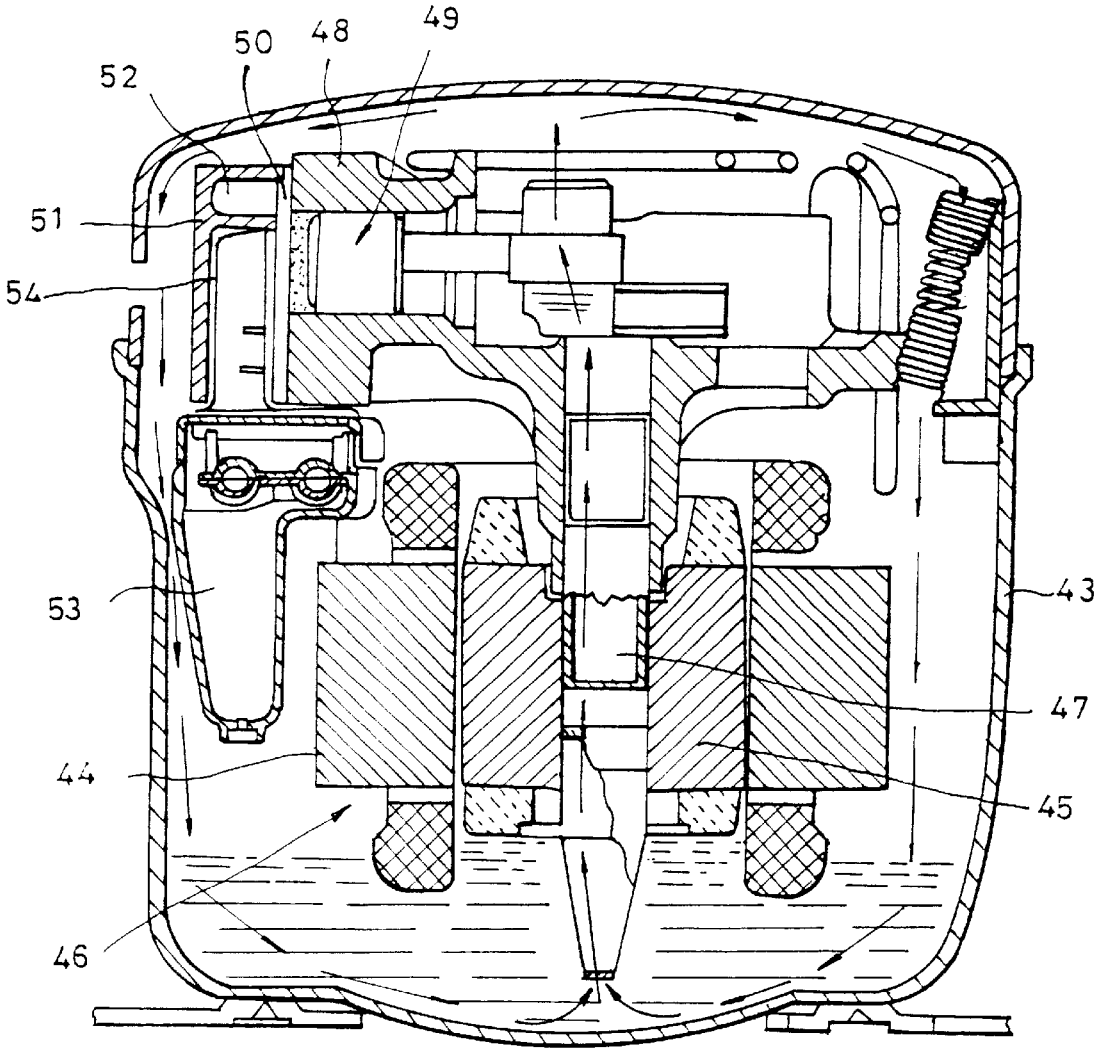
FIG. 6 CONVENTIONAL ART
FIG. 6 is a cross-sectional view illustrating the construction of still another conventional hermetic compressor.
Figure 7:
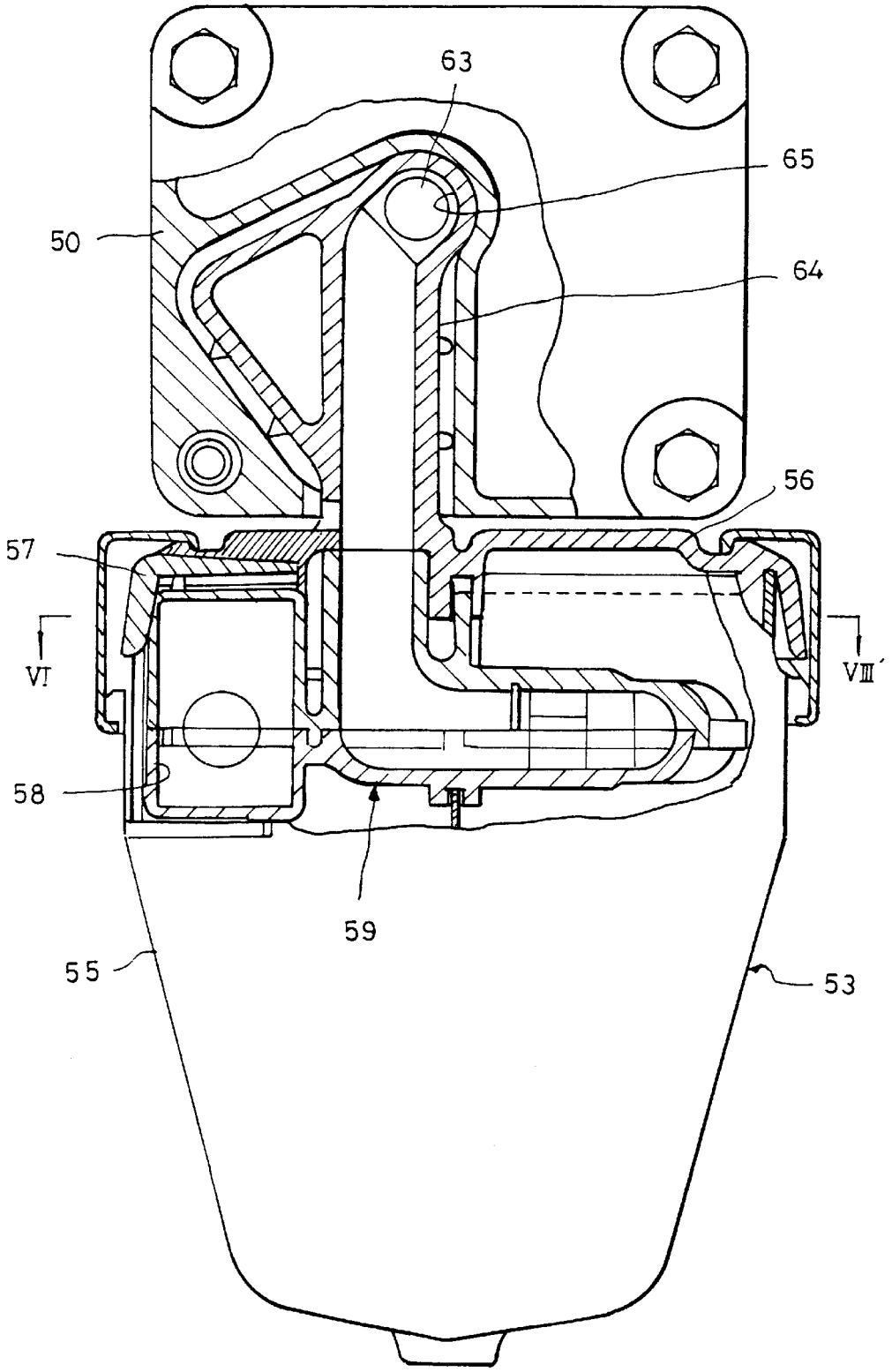
FIG. 7 CONVENTIONAL ART
FIG. 7 is a partial cut-away view of FIG. 6.
Figure 8:
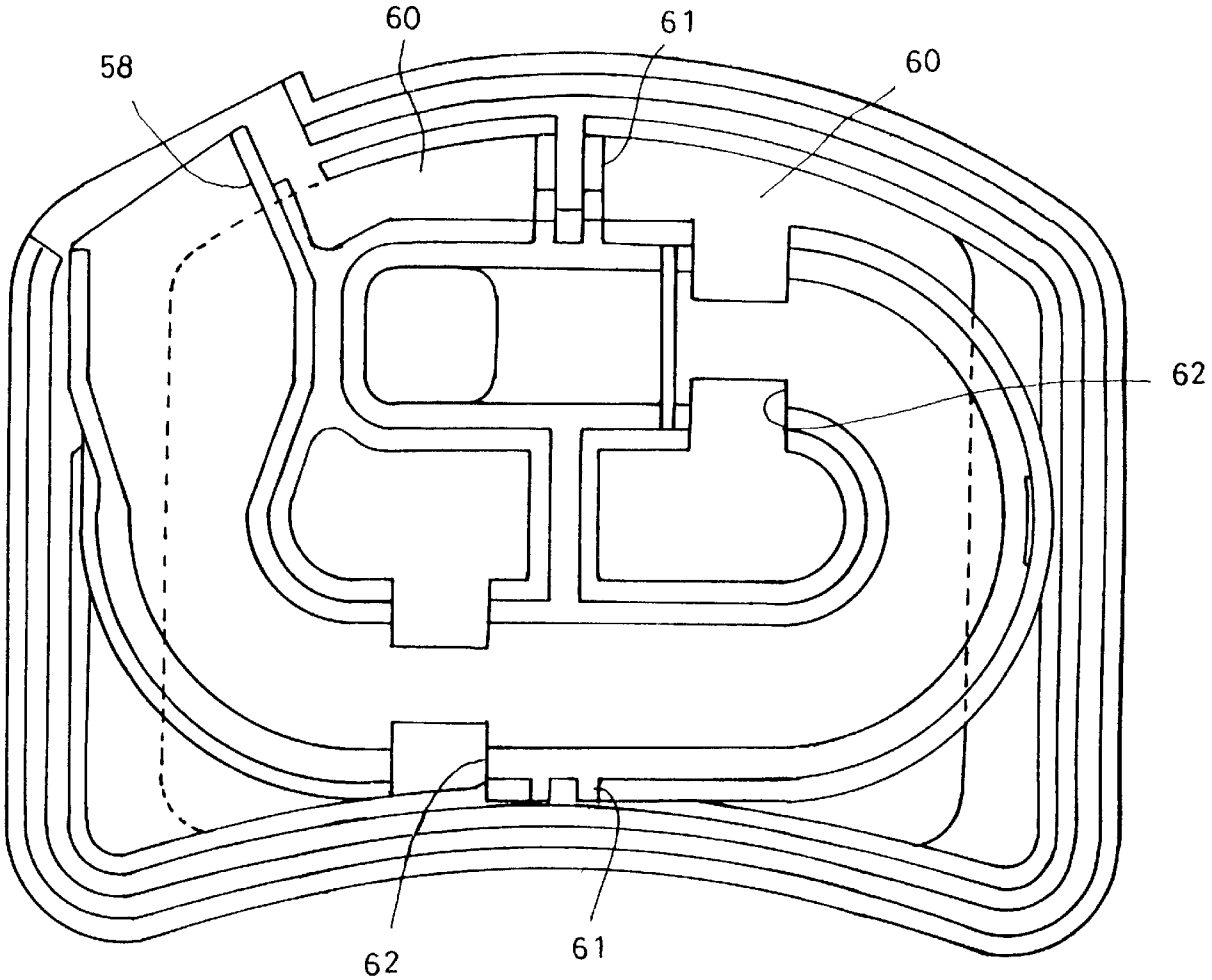
FIG. 8 CONVENTIONAL ART
FIG. 8 is a cross-sectional view taken along line VII-I–VIII' of FIG. 7.

Referring to FIGS. 9 through 12, a suction noise muffler for a hermetic muffler according to a first embodiment of the present invention will now be explained.

As shown therein, an upper casing 70 having a rectangular upper casing outer wall 71 and a lower casing 80 having a rectangular lower casing outer wall 81 mating with the upper casing outer wall 71 are coupled to each other.

The upper casing 70 includes a first protrusion 72 formed on the outer upper portion of the upper casing outer wall 71, with a first wall 73 being downwardly extended from the periphery of the first protrusion 72 to the bottom portion of the upper casing outer wall 71.

A second wall 74 downwardly extended from the periphery of the first protrusion 72 and having a curved portion is formed parallel with the first wall 73, with a predetermined width being formed between the first wall 73 and the second wall 74. A third wall 75 is horizontally formed between one side of the upper casing outer wall 71 and the lower end portion of the first wall 73.

A horn-shaped suction inlet 76 is formed in a portion of the upper casing outer wall 71 in order for a refrigerant gas to be introduced therethrough. A first inlet/outlet hole 77 is formed in the third wall 75.

Figure 9:
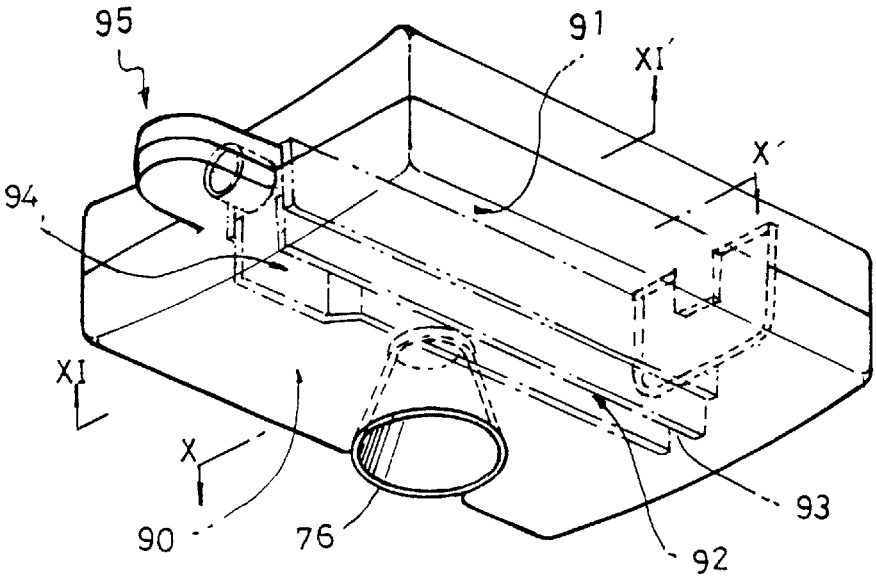
FIG. 9 is a perspective view illustrating a suction noise muffler of a hermetic compressor according to the present invention so as to show an upper casing and a lower casing of the suction noise muffler coupled together.
Figure 10:
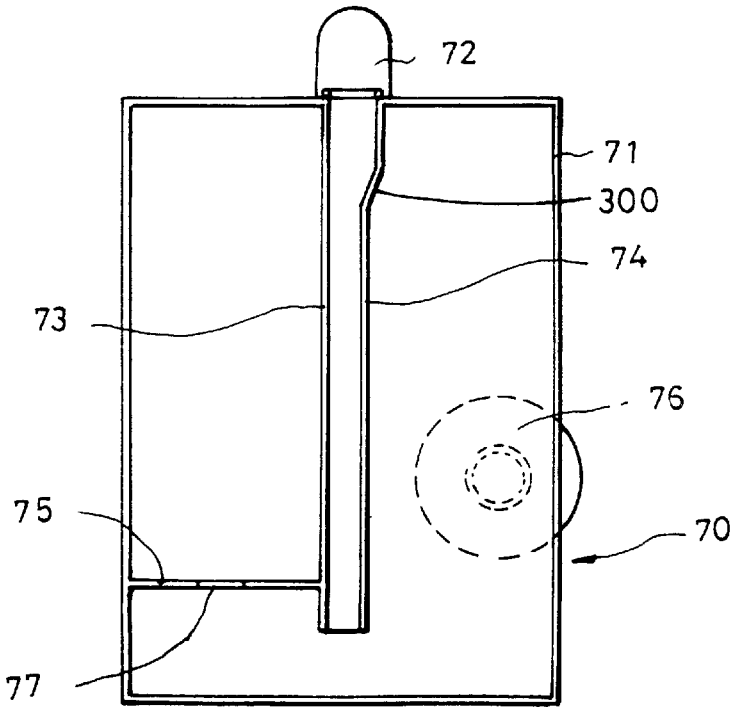
FIG. 10 is a cross-sectional view illustrating an upper casing of a suction noise muffler according to the present invention, which view is taken along line X–X' of FIG. 9.
Figure 11:
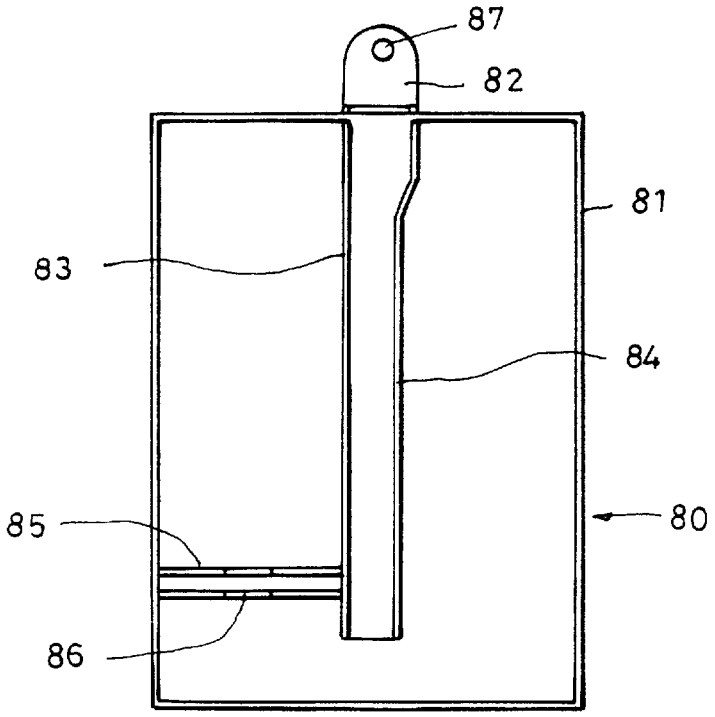
FIG. 11 is a cross-sectional view illustrating a lower casing of a suction noise muffler according to the present invention, which view is taken along line XI–XI' of FIG. 9.
Figure 12:
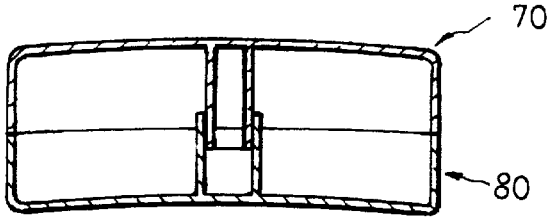
FIG. 12 is a horizontal cross-sectional view illustrating a suction noise muffler according to a first embodiment of the present invention.

In the lower casing 80, a second protrusion 82 is formed in the outer upper portion of the lower casing outer wall 81, with t1 second protrusion 82 mating with the first protrusion 72 of the upper casing 70, for thus forming a discharge port 95 shown in FIG. 9 between the first and second protrusions 72 and 82. A fourth wall 83 is downwardly extended from the periphery of the second protrusion 82.

An outlet 87 is formed at the top end of the second protrusion 82 in order for the refrigerant gas to be discharged therethrough. A fifth wall 84 is downwardly extended from the periphery of the second protrusion 82 and is parallel to the fourth wall 83. Therefore, a predetermined width is formed between the fourth and fifth walls 83 and 84. Here, the width of the lower casing 80 is greater than that of the upper casing 70, whereby the upper casing 70 is substantially and tightly inserted into the lower casing 80 by inserting the first and second walls 73 and 74 into the fourth and fifth walls 83 and 84 when assembling the upper and lower casings 70 and 80. A pair of spaced-apart sixth walls 85 are horizontally formed between one side of the lower casing outer wall 81 and the fourth wall 83 in order for the third wall 75 of the upper casing 70 to be substantially and tightly inserted between the sixth walls 85 when assembling the upper and lower casings 70 and 80.

A second inlet/outlet hole 86 is formed in a portion of the sixth walls 85, with the second inlet/outlet hole 86 mating with the first inlet/outlet hole 77 of the upper casing 70 when the upper and lower casings 70 and 80 are coupled to each other.

When the upper and lower casings 70 and 80 are assembled together, a first noise reducing section 90 is formed in one side of the suction noise muffler and is encircled by the upper casing outer wall 71 and the second and third walls 74 and 75 of the upper casing 70, and by the lower casing outer wall 81 and the fifth and sixth walls 84 and 85 of the lower casing 80, so that noise contained in the refrigerant gas introduced into the interior of the suction noise muffler through the suction inlet 76 can be reduced.

A second noise reducing section 91 is formed opposite the first noise reducing section 90 with respect to the first and second walls 73 and 74 of the upper casing 70 and is encircled by the upper casing outer wall 71, the first and third walls 73 and 75 of the upper casing 70 and by the lower casing outer wall 81, the fourth wall 83, and the sixth wall 85 of the lower casing 80, so that a specific band width of the noise generated by the refrigerant gas is filtered thereby.

A guide path 92 is formed at the central portion of the interior of the suction noise muffler and is encircled by the first and second walls 73 and 74 of the upper casing 70, and the fourth and fifth walls 83 and 84 of the lower casing 80.

An inlet 93 is formed at one end of the guide path 92 in order for the refrigerant gas to be introduced therethrough. An outlet 94 which is larger than the inlet 93 is formed at another end of the guide path 92 in order for the refrigerant gas to be more rapidly discharged.

Figure 13:
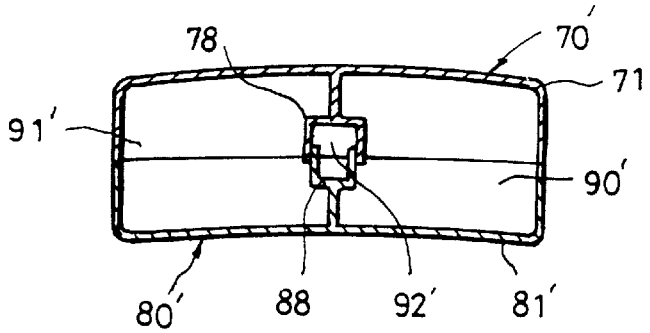
FIG. 13 is a horizontal cross-sectional view illustrating a suction noise muffler according to a second embodiment of the present invention.
Figure 14:
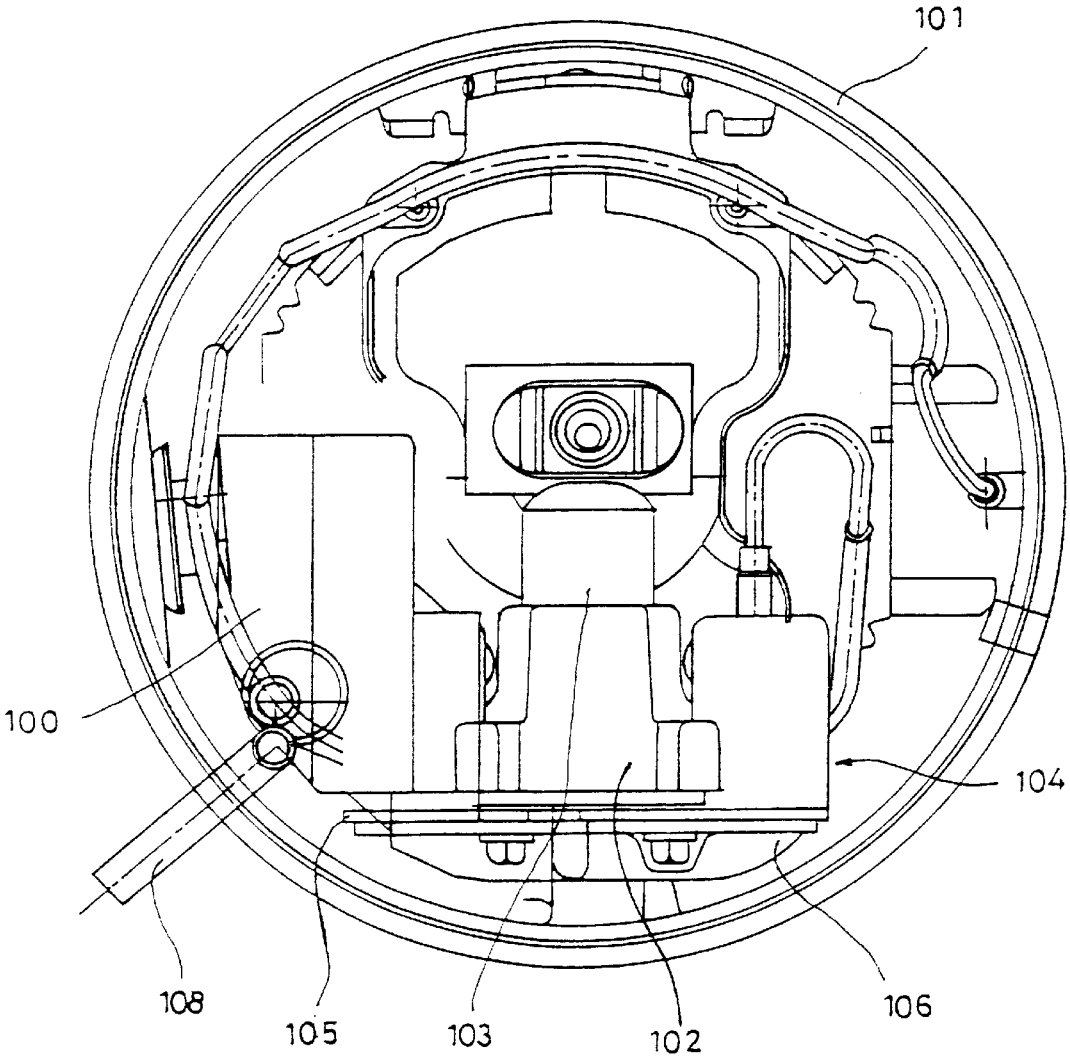
FIG. 14 is a plan view illustrating a hermetic compressor in which a suction noise muffler of FIG. 12 is arranged according to the present invention.

FIG. 13 illustrates a suction noise muffler according to another embodiment of the present invention. The suction noise includes an upper casing 70' and a lower casing 80'.

A channel-shaped upper casing wall 78 is formed in a portion of the upper casing 70', and a channel-shaped lower casing wall 88 is formed in a portion of the lower casing 80', with the lower casing wall 88 being inserted into the upper casing wall 78, for thus forming a guide path 92' when the upper and lower casings 70' and 80' are coupled together.

A first noise reducing section 90' is formed in one side of the suction noise muffler by an upper casing outer wall 71' of the upper casing 70' the upper casing wall 78, a lower casing outer wall 81' of the lower casing 80' and the lower casing wall 88. A second noise reducing section 91' is formed in another side of the suction noise muffler by the upper casing outer wall 71' of the upper casing 70' the upper casing wall 78, the lower casing outer wall 81' of the lower casing 80', and the lower casing wall 8.

The operation and effects of the suction noise muffler for a hermetic compressor according to the present invention will now be explained First, when the upper casing 70 and the lower casing 80 are coupled, the first and second walls 73 and 74, and the third wall 75 of the upper casing 70 are inserted into the fourth and fifth walls 83 and 84 and the sixth wall 85, respectively.

Thereafter, a partial ultrasonic melting process is performed with respect to an insertion portion between the upper and lower casings 70 and 80. As a result, the upper casing outer wall 71 is melted with the lower casing outer wall 81, and the first protrusion 72 is melted with the second protrusion 82.

In the above state, when a current is supplied to the motor unit (not shown), the piston of the compression section (not shown) reciprocates within the cylinder (not shown), for thus generating a suction force and a discharge force.

The thusly generated suction force causes the refrigerant gas to be introduced into the suction inlet 76. The noise having a specific band width and contained in the thusly introduced refrigerant gas is reduced by the first noise reducing section 90.

The refrigerant gas in the first noise reducing section 90 is introduced into the second noise reducing section 91 through the inlet/outlet holes (not shown), and the noise having a specific band width and contained in the refrigerant gas is reduced by the second noise reducing section 91. The refrigerant gas discharged to the first noise reducing section 90 through the inlet/outlet hole (not shown) from the second noise reducing section 91 is discharged to the inlet/outlet port 94 through the inlet 93 of the guide path 92.

Here, since the size of the outlet 94 of the guide path 92 is larger than the inlet 93, the refrigerant gas can be more easily discharged.

The operation of another embodiment of the present invention as shown in FIG. 13 is performed in the same manner as in the above-described operation.

As described above, the present invention is directed to more easily forming the first noise reducing section, a predetermined shaped guide path, and the second noise reducing section by just simply coupling the upper casing and the lower casing, for thus increasing the productivity of the suction noise muffler.

In addition, it is possible to minimize the formation of burr which occurs due to a partial melting process, for thus enhancing the performance of the suction noise muffler.

Meanwhile, FIGS. 14 through 21 illustrate a suction noise muffler 100 for a hermetic compressor according to still another embodiment of the present invention. A compression section 104 having a cylinder 102 and a piston 103 is disposed in the upper portion of a housing 101. A valve plate 105 is attached at one end of the cylinder 102.

Cylinder head covers 106 are attached to the valve plate 105. The suction noise muffler 100 is attached to the cylinder head covers 106. A suction pipe 108 is connected to the lower portion of the suction noise muffler 100.

The suction noise muffler 100 includes a predetermined shaped upper casing 110 and lower casing 140.

Figure 15:
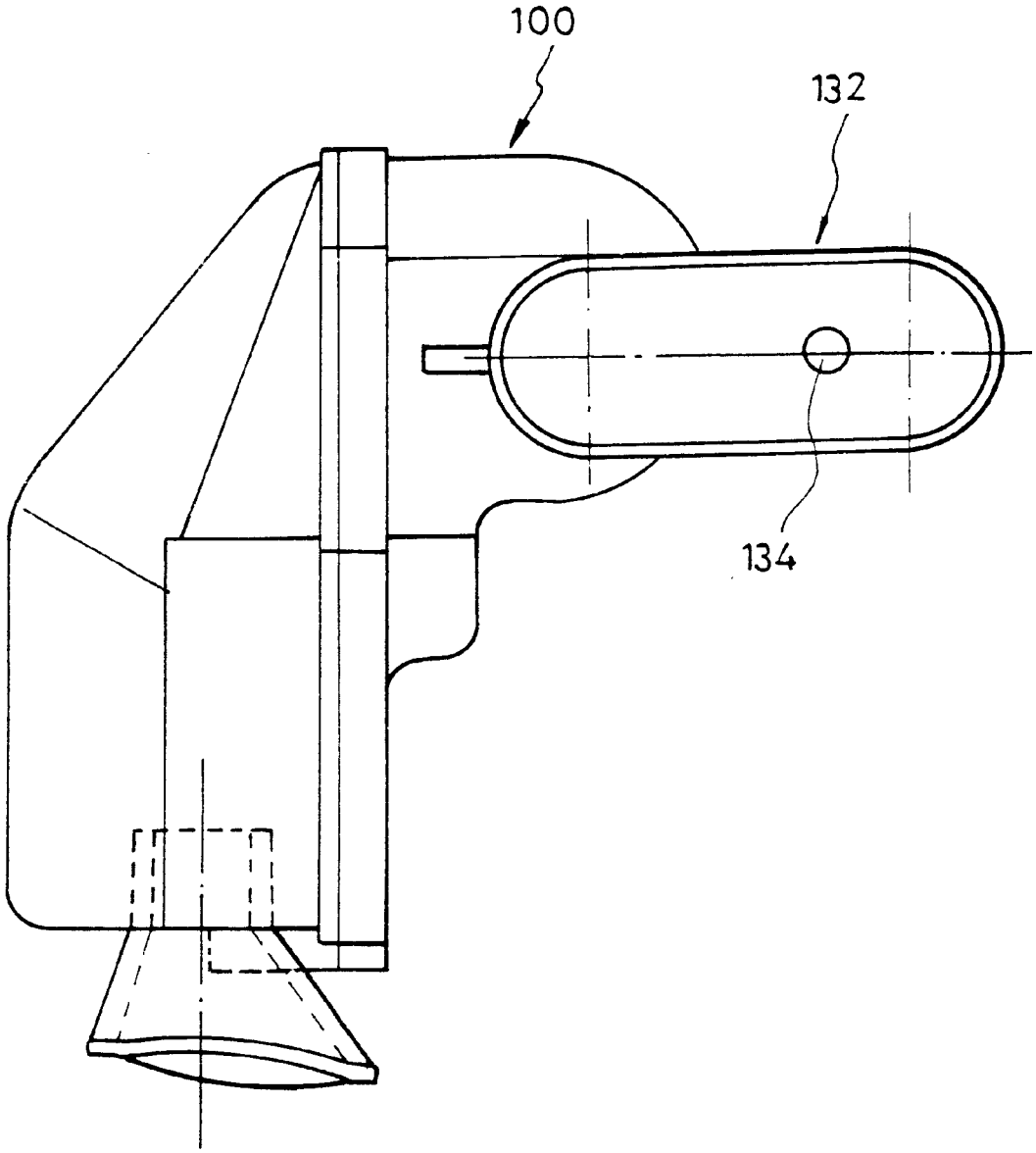
FIG. 15 is a side view illustrating a suction noise muffler of FIG. 12.
Figure 16:
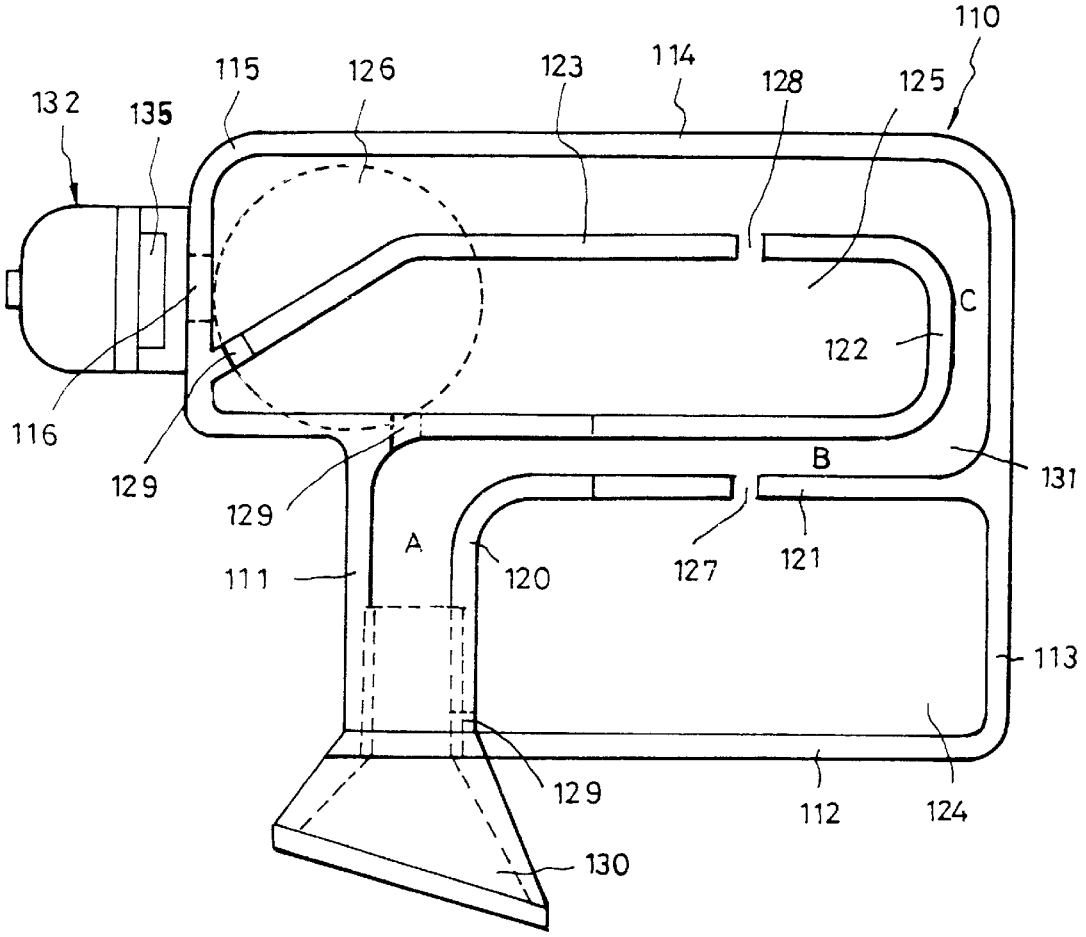
FIG. 16 is a cross-sectional view illustrating an upper casing of a suction noise muffler of FIG. 14 according to the present invention.

As shown in FIG. 15, the upper casing 110 is generally encircled by a vertically elongated first outer wall 111, a horizontally elongated second outer wall 112, a vertically elongated third outer wall 113, a horizontally elongated fourth wall 114, and a vertically elongated fifth outer wall 115. Here, a horn-shaped inlet 130 is arranged between the first outer wall ill and the second outer wall 112, through which a refrigerant gas is introduced into the interior which is defined when the upper casing 110 and the lower casing 140 are coupled together.

A first noise reducing section 124 is formed in a lower portion inside the upper casing 110. The first noise reducing section 124 is encircled by a vertically elongated first inner wall 120, a horizontally elongated second inner wall 121, and the vertically elongated third outer wall 113, and the horizontally elongated second outer wall 112, with a first inlet hole 127 being formed between the first inner wall 120 and the second inner wall 121, and with a first lubricating oil outlet 129 being formed between the first inner wall 120 and the second outer wall 112.

A second noise reducing section 125 is formed at an intermediate portion inside the upper casing 110. The second noise reducing section 125 is encircled by a lying U-shaped third inner wall 122 and a bent fourth inner wall 123, with a second lubricating outlet 129-1 being formed in the lower section of the third inner wall 122, and with a third lubricating outlet 129-2 being formed between the third inner wall 122 and the fourth inner wall 123.

A third noise reducing section 126 is formed between the bent fourth inner wall 123 and the fourth outer wall 114, with a second inlet 128 being formed in the horizontal portion of the fourth inner wall 123.

A predetermined shaped first space "A" is formed between the first outer wall 111 and the first inner wall 120, with a horn-shaped inlet 130 being integrally attached to the lower portion of the predetermined shaped space. A predetermined shaped second space "B" is formed between the lower section of the third inner wall 122 and the first and second inner walls 120 and 121. In addition, a predetermined shaped third space "C" is formed between the third inner wall 122 and the third outer wall 113.

Here, the first, second, and third spaces "A", "B", and "C" communicate with one another. The first noise reducing section 124 communicates with the first space "A" through the first lubricating outlet 129. The first noise reducing section 124 communicates with the second space "B"

through the first inlet hole 127. The second noise reducing section 125 communicates with the first space "A" through the second lubricating oil outlet 129-1. The second noise reducing section 125 and the third noise reducing section 126 communicate with each other through the third lubricating oil outlet 129-2 and the second inlet 128.

A fixing section 132 having a second protrusion is integrally attached to the fifth outer wall 115 and communicates with the third noise reducing section 126 through an outlet 116. In addition, the fixing section 132 is clamped to the valve plate 105 by a clamp 150.

Figure 17:
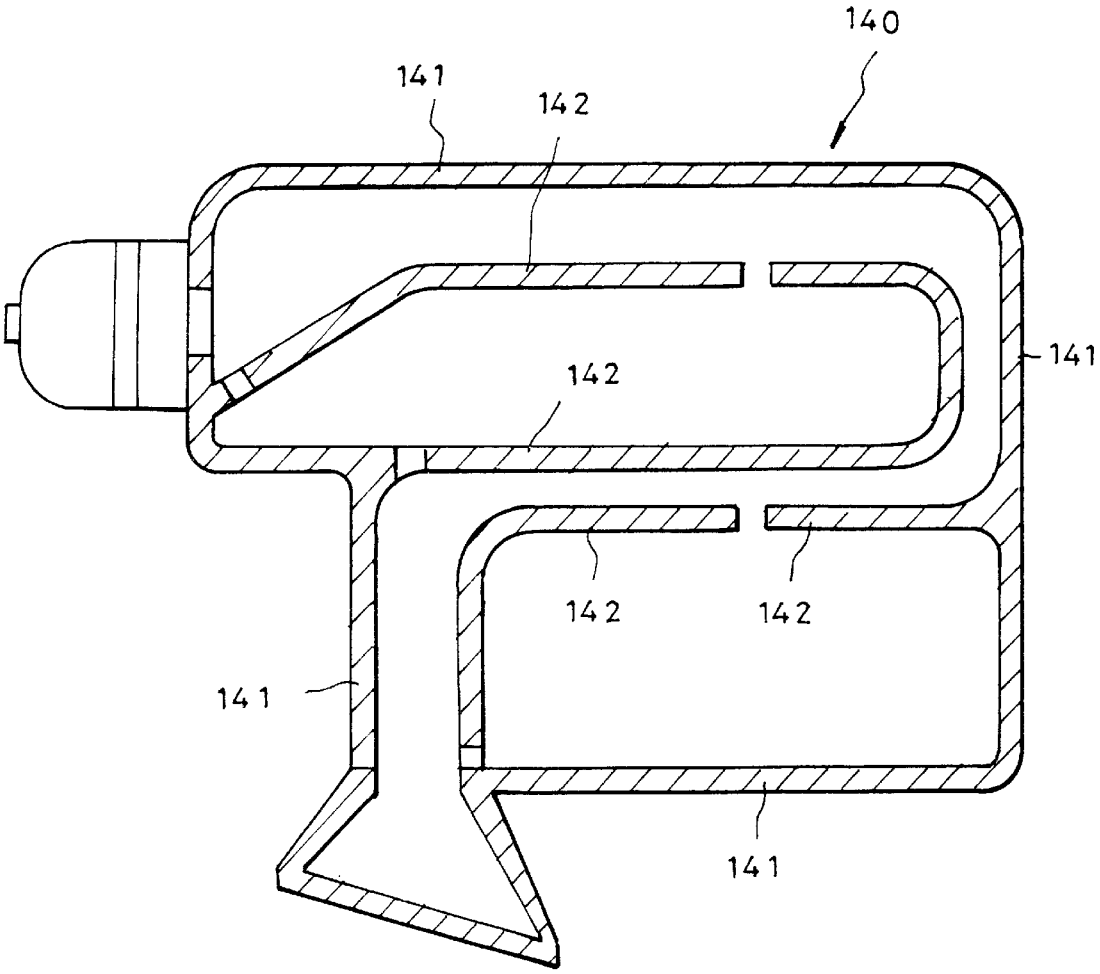
FIG. 17 is a cross-sectional view illustrating a lower casing of a suction noise muffler of FIG. 14 according to the present invention.

As shown in FIG. 17, the lower casing 140 has the same construction as the upper casing. Namely, the lower casing 140 includes an outer casing 141 encircling the same, and an inner wall 142.

Figure 18:
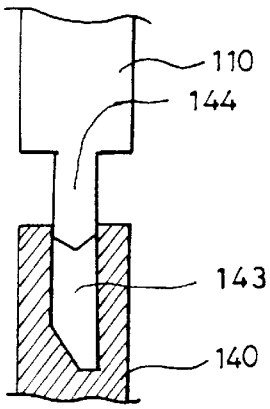
FIG. 18 is an enlarged cross-sectional view illustrating an engaging portion between an upper casing and a lower casing of a suction noise muffler according to the present invention.
Figure 19:
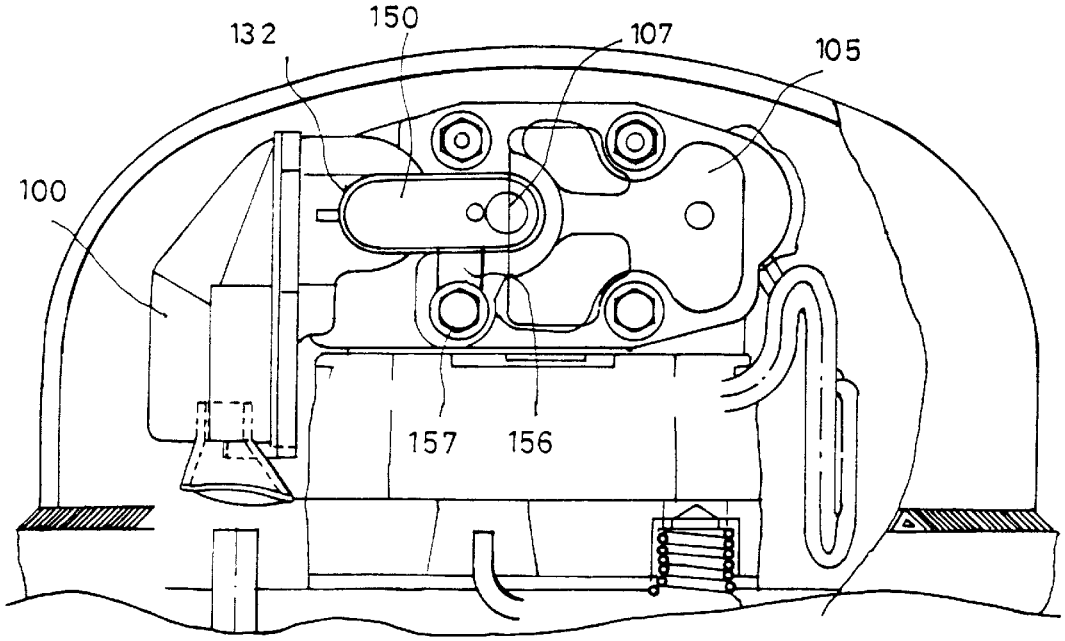
FIG. 19 is a side cross-sectional view illustrating a suction noise muffler engaged to a valve plate of FIG. 14 according to the present invention.
Figure 20:
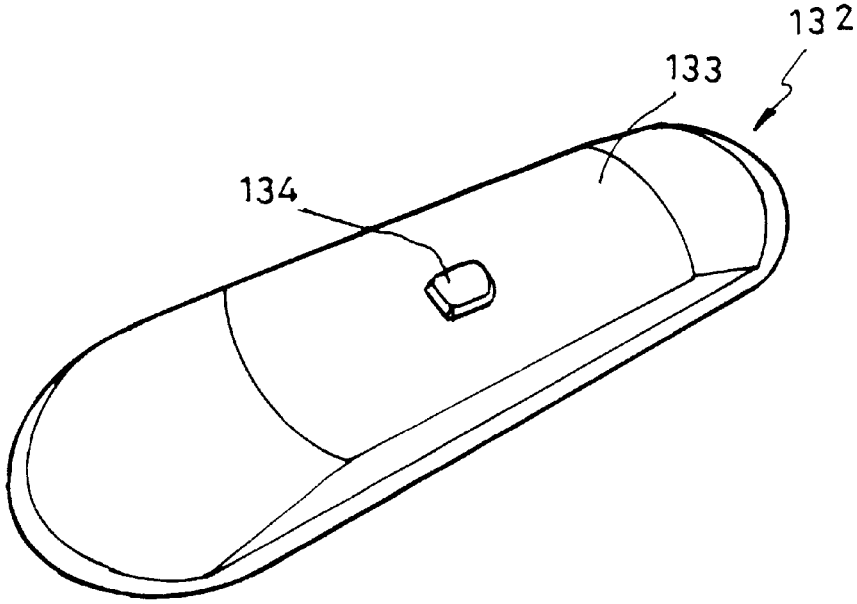
FIG. 20 is a perspective view illustrating a fixing member of a suction noise muffler of FIG. 14 according to the present invention.
Figure 21:
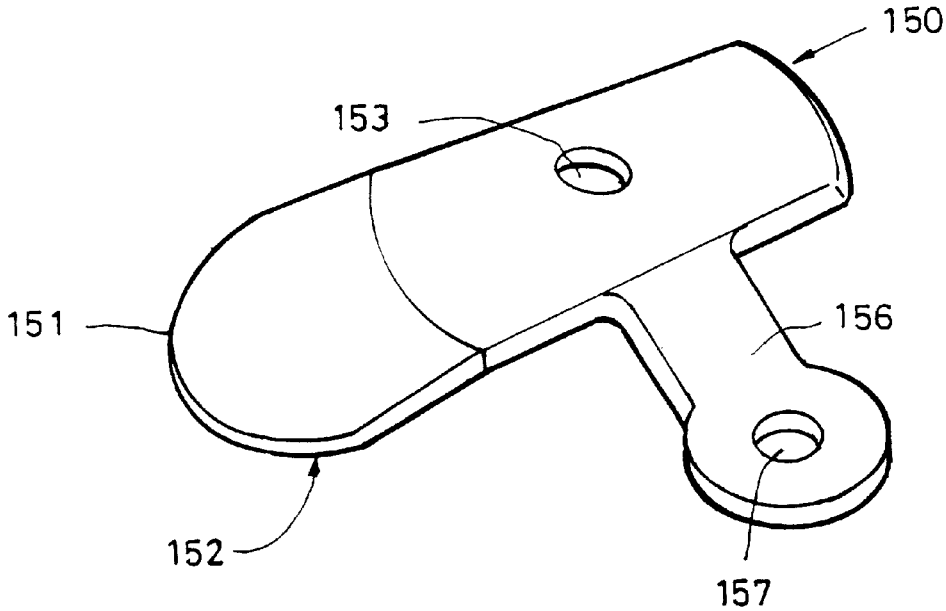
FIG. 21 is a perspective view illustrating a clamp for clamping the suction noise muffler to a valve plate of FIG. 14 according to the present invention.

As shown in FIG. 18, the top portions of the inner and outer walls of the upper casing 110 have an elongated protrusion having a predetermined height. In addition, the top portions of the inner and outer walls of the lower casing 140 have an elongated groove having a predetermined depth. Therefore, the protrusions of the inner and outer walls of the upper casing 110 are inserted into the grooves of the inner and outer walls of the lower casing 140. The height of the protrusions is shorter than the depth of the grooves for preventing bur formations when welding the upper and lower casing 110 and 104 using an ultrasonic welding method. On the contrary, the upper casing 110 may have such a groove, and the lower casing 140 may have such a protrusion.

The clamp 150 includes an attaching section 151 and an engaging plate 156. The attaching section 151 includes an attaching surface 152 in order for the attaching surface 152 to be tightly attached to a protruded surface 133 of the fixing section 132, and the engaging plate 156 is formed in the attaching section 151 for being engaged with the valve plate 105.

An insertion hole 153 is formed in the attaching surface 152 for receiving a first protrusion 134 therethrough when the attaching surface 152 and the protruded surface 133 are attached to each other. An engaging hole 157 is formed in an end portion of the engaging plate 156, into which an engaging member is inserted.

The operation and effects of the suction noise muffler for a hermetic compressor according to the present invention will now be explained with reference to the accompanying drawings.

First, when assembling the upper casing 110 and the lower casing 140, the protrusions 144 formed in the top portions of the outer and inner walls of the upper casing 110 are inserted into the grooves 143 formed on the top portions of the outer and inner walls of the lower casing 140.

A ultrasonic wave is applied to the engaging portion between the upper casing 110 and the lower casing 140, and the thusly inserted protrusions 144 are melted with the grooves 143 of the lower casing 140. Here, since the height of the protrusions 144 is shorter than the depth of the grooves 143, a melting material is substantially filled into the grooves 143.

The process for installing the suction noise muffler 100 in the housing 101 and the operation thereof will now be explained in more detail.

First, the inlet 130 of the suction noise muffler 100 is placed above the suction pipe 52, and the fixing section 132 is placed at the valve plate 105. The protruded surface 133 of the fixing member 132 is attached to the attaching surface 152 of the clamp 150, and the first protrusion 134 of the fixing section 132 is inserted into the insertion hole 153 of the attaching section 151 of the clamp 150.

The engaging member is inserted into the engaging hole 157 of the engaging plate 156 of the clamp 150 having the insertion hole 132 into which the fixing section 132 of the suction noise muffler 100 is inserted, and the clamp 150 is attached to the valve plate 105, so that the suction noise muffler 100 is fixed thereby.

In a state that the suction noise muffler 100 is fixed, when the compression section 104 is driven, the refrigerant gas is introduced into the inlet 130 of the suction noise muffler 100 through the suction pipe 108 in cooperation with the suction force. The thusly introduced refrigerant gas moves to the first and second and third noise reducing sections 124, 125, and 126 through the guide path 131, and the noise contained in the refrigerant gas is gradually reduced by the first, second and third suction noise reducing sections 124, 125, and 126.

The refrigerant gas discharged to the fixing section 132 through the outlet 116 of the fifth outer wall 115 is introduced into the cylinder 102 through the suction hole 107 of the valve plate 105, and the refrigerant gas introduced into the cylinder 102 is compressed by the piston 103, and moves to a discharge noise muffler (not shown) through the valve plate 105.

In addition, a lubricating oil contained in the refrigerant gas is gathered at the bottom portion of each of the first, second, and third oil reducing sections 124, 125, and 156 and is then discharged to the outside through the first, second and third lubricating oil outlets 129, 129-1, and 129-2.

As described above, the suction noise muffler for a hermetic compressor according to the present invention is directed to fabricating the upper casing and lower casing which are symmetrical and have predetermined refrigerant gas flowing spaces "A", "B", and "C", and a plurality of noise reducing sections. The upper casing and lower casing are assembled each other, and are melted by supersonic wave, for thus enhancing the productivity.

In addition, it is possible to enhance the efficiency of the refrigerant gas flow and the suction noise reducing by forming predetermined shaped refrigerant gas flowing spaces and paths and a plurality of suction noise reducing sections.

Moreover, it is possible to increase the productivity of the compressor by simply fixing the suction noise muffler to the valve plate using a clamp.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A suction noise muffler for a hermetic compressor, comprising:

an upper casing and a lower casing wherein the upper casing and the lower casing are substantially mirror images of each other; and each casing comprising an inlet formed at a lower portion of the casing, through which a refrigerant gas is introduced;

a first noise reducing section formed at the lower portion inside the casing and encircled by a first inner wall, a second inner wall, a second outer wall, and a third outer wall;

a second noise reducing section formed at an intermediate portion inside the casing and encircled by a third inner wall and a fourth inner wall;

a third noise reducing section formed at an upper portion inside the casing and encircled by the fourth inner wall and a fifth outer wall;

a fixing section integrally attached to the fifth outer wall; and a guide path formed inside the casing at the inlet and extending to the fixing section.

2. The muffler of claim 1, wherein said outer and inner walls of the upper casing include a plurality of either elongating protrusions or elongating grooves.

3. The muffler of claim 1, wherein said outer and inner walls of the lower casing include a plurality of either elongating protrusions or elongating grooves formed on the top portion thereof, whereby the protrusions of the upper casing or the lower casing mate with the grooves of the lower casing or the upper casing.

4. The muffler of claim 1, wherein said inlet is horn-shaped in order for a refrigerant gas to be more easily introduced therethrough.

5. The muffler of claim 1, wherein said plurality of noise reducing sections include a lubricating oil outlet formed in the bottom portion of each of the noise reducing sections, respectively, for discharging a lubricating oil contained in the refrigerant gas.

6. The muffler of claim 1, wherein said fixing section includes:

a protruding surface attached to a head cover;

a first protrusion protruding from a portion of the protruding surface; and a second protrusion protruded at the outer circumferential surface thereof for being inserted into a suction hole of the valve plate.

7. The muffler of claim 2, wherein said groove of the lower casing includes a predetermined depth deeper than the height of the protrusion of the upper casing.

8. The muffler of claim 3, wherein said groove of the upper casing includes a predetermined depth deeper than the height of the protrusion of the lower casing.

9. The muffler of claim 6, wherein said fixing section is fixed to the valve plate by a clamp.

10. The muffler of claim 9, wherein said clamp includes:

an attaching portion formed on the attaching surface for being attached to the protruded surface of the fixing section;

an engaging plate protruded from one side of the attaching section;

an insertion hole formed in a portion of the attaching surface in order for the first protrusion to be inserted thereinto when the attaching surface is attached to the protruded surface of the fixing section; and an engaging hole formed in a portion of the engaging plate for fixing the fixing section inserted into the insertion hole to the valve plate in cooperation with an engaging member.

* * * * *